US010423092B2

(12) United States Patent
Iwasaki et al.

(10) Patent No.: US 10,423,092 B2
(45) Date of Patent: Sep. 24, 2019

(54) CLEANING MEMBER, CHARGING DEVICE, AND IMAGE FORMING APPARATUS

(71) Applicant: FUJI XEROX CO., LTD., Tokyo (JP)

(72) Inventors: Jin Iwasaki, Kanagawa (JP); Ken Ozaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/915,670

(22) Filed: Mar. 8, 2018

(65) Prior Publication Data

US 2019/0094742 A1 Mar. 28, 2019

(30) Foreign Application Priority Data

Sep. 27, 2017 (JP) ..... 2017-187022

(51) Int. Cl.

*G03G 15/02* (2006.01)
*G03G 21/00* (2006.01)
*G03G 15/16* (2006.01)

(52) U.S. Cl.

CPC ..... *G03G 15/0225* (2013.01); *G03G 15/0258* (2013.01); *G03G 21/0058* (2013.01); *G03G 15/168* (2013.01); *G03G 2215/021* (2013.01); *G03G 2215/1647* (2013.01); *G03G 2221/0089* (2013.01)

(58) Field of Classification Search

CPC ..... G03G 15/0225; G03G 15/168; G03G 15/0258; G03G 15/2025; G03G 15/2075; G03G 21/0035; G03G 21/0058; G03G 2215/021; G03G 2215/1647; G03G 2215/1652; G03G 2215/1657; G03G 2215/1661; G03G 2221/0089; G03G 2221/0005

USPC ..... 399/99, 100, 101, 176, 327, 353, 357

See application file for complete search history.

(56) References Cited

U.S. PATENT DOCUMENTS 4,407,219 A * 10/1983 Dellevoet ..... G03G 15/2025 118/104
5,923,940 A * 7/1999 Baldwin ..... G03G 21/0035 15/1.51
7,343,133 B2 * 3/2008 Ueno ..... G03G 21/0035 399/353
9,025,993 B2 * 5/2015 Iwasaki ..... G03G 15/0225 399/100

(Continued)

FOREIGN PATENT DOCUMENTS

JP 04020304 A * 1/1992
JP 08-137208 A 5/1996

(Continued)

*Primary Examiner* — Robert B Beatty
(74) *Attorney, Agent, or Firm* — Sughrue Mion, PLLC

(57) ABSTRACT

A cleaning member includes a first cleaning part formed of a porous material and a second cleaning part formed of a porous material. The first cleaning part includes first projections each having a size that enables the first projections to pass between projecting portions of an object to be cleaned having surface irregularities and to reach the bottom of recessed portions of the object to be cleaned. The second cleaning part includes second projections larger than the first projections. The cleaning member cleans the object to be cleaned by coming into contact with the object to be cleaned.

13 Claims, 7 Drawing Sheets

(56) References Cited

U.S. PATENT DOCUMENTS

| | | | | |
|---|---|---|---|---|
| 2008/0063447 | A1* | 3/2008 | Kawahara | G03G 21/0005 399/346 |
| 2014/0037320 | A1* | 2/2014 | Berens | G03G 15/0225 399/100 |
| 2018/0275553 | A1* | 9/2018 | Iwasaki | G03G 15/0258 |

FOREIGN PATENT DOCUMENTS

| | | | | |
|---|---|---|---|---|
| JP | 2006195451 | A | * | 7/2006 |
| JP | 2007-241106 | A | | 9/2007 |
| JP | 2008122484 | A | * | 5/2008 |
| JP | 2008129355 | A | * | 6/2008 |
| JP | 2017211621 | A | * | 11/2017 |

* cited by examiner

FIG. 8

| | FIRST SPONGE | | SECOND SPONGE | | CHARGING ROLLER | | EVALUATION RESULT | |
|---|---|---|---|---|---|---|---|---|
| | NODE PORTION MAXIMUM DIMENSION da [μm] | NODE PORTION HEIGHT la [μm] | NODE PORTION MAXIMUM DIMENSION db [μm] | NODE PORTION HEIGHT lb [μm] | SURFACE Sm [μm] | SURFACE Rz [μm] | LINE ON PRINT SAMPLE | SEM OBSERVATION RESULT OF CHARGING ROLLER SURFACE |
| EXPERIMENTAL EXAMPLE 1 | 50 | 100 | WITHOUT SECOND SPONGE | | 80 | 10 | FEW | STAIN ACCUMULATION ON RECESSED PORTIONS IS SMALL<br>AMOUNT OF STAIN STICKING TO PROJECTING PORTIONS IS SMALL AND TOLERABLE |
| EXPERIMENTAL EXAMPLE 2 | 100 | 200 | | | 150 | 3.5 | VERY FEW | STAIN ACCUMULATION ON RECESSED PORTIONS IS SMALL<br>STAIN ACCUMULATION ON PROJECTING PORTIONS IS SMALL |
| COMPARATIVE EXAMPLE 1 | 100 | 200 | | | 80 | 10 | MANY | STAIN ACCUMULATION ON RECESSED PORTIONS IS VERY LARGE<br>STAIN ACCUMULATION ON PROJECTING PORTIONS IS SMALL |
| COMPARATIVE EXAMPLE 2 | 200 | 500 | | | 150 | 3.5 | MANY | STAIN ACCUMULATION ON RECESSED PORTIONS IS VERY LARGE<br>STAIN ACCUMULATION ON PROJECTING PORTIONS IS VERY SMALL |
| EXPERIMENTAL EXAMPLE 3 | 50 | 100 | 100 | 200 | 80 | 10 | VERY FEW | STAIN ACCUMULATION ON RECESSED PORTIONS IS SMALL<br>STAIN ACCUMULATION ON PROJECTING PORTIONS IS SMALL |
| EXPERIMENTAL EXAMPLE 4 | 100 | 200 | 200 | 500 | 150 | 3.5 | NONE | STAIN ACCUMULATION ON RECESSED PORTIONS IS SMALL<br>STAIN ACCUMULATION ON PROJECTING PORTIONS IS VERY SMALL |

CLEANING MEMBER, CHARGING DEVICE, AND IMAGE FORMING APPARATUS

CROSS-REFERENCE TO RELATED APPLICATIONS

This application is based on and claims priority under 35 USC 119 from Japanese Patent Application No. 2017-187022 filed Sep. 27, 2017.

BACKGROUND

Technical Field

The present invention relates to a cleaning member, a charging device, and an image forming apparatus.

SUMMARY

According to an aspect of the invention, there is provided a cleaning member that includes a first cleaning part formed of a porous material and a second cleaning part formed of a porous material. The first cleaning part includes first projections each having a size that enables the first projections to pass between projecting portions of an object to be cleaned having surface irregularities and to reach the bottom of recessed portions of the object to be cleaned. The second cleaning part includes second projections larger than the first projections. The cleaning member cleans the object to be cleaned by coming into contact with the object to be cleaned.

BRIEF DESCRIPTION OF THE DRAWINGS

Exemplary embodiments of the present invention will be described in detail based on the following figures, wherein:

FIG. 8 is a table showing experimental results of experimental examples and comparative examples;

DETAILED DESCRIPTION

Figure 1:
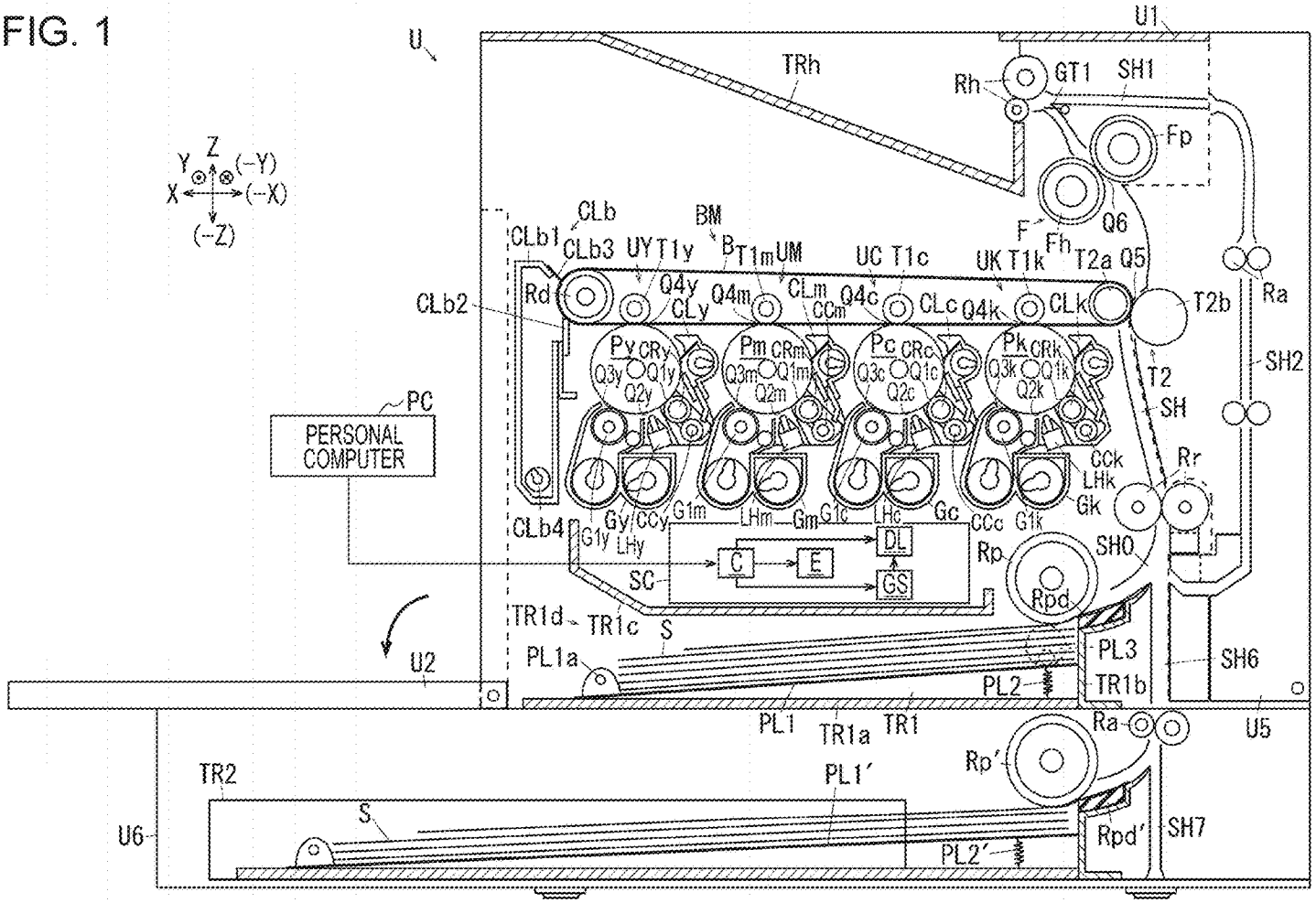
FIG. 1 is an explanatory view of a printer according to a first exemplary embodiment of the invention.

With reference to the drawings, exemplary embodiments, which are specific examples of an aspect of the invention, will be described; however, the invention is not limited to the exemplary embodiments described below.

In the drawings, for ease of understanding the following description, a front-rear direction, a left-right direction, and an up-down direction are indicated by an X axis, a Y axis, and a Z axis, respectively, and the forward, rearward, rightward, leftward, upward, and downward directions, as well as the front, rear, right, left, upper, and lower sides, are indicated by arrows X, -X, Y, -Y, Z, and -Z, respectively.

In FIG. 1, a symbol of a dot in a circle denotes an arrow that indicates a direction from the back to the front of the sheet of FIG. 1, and a symbol of a cross in a circle denotes an arrow that indicates a direction from the front to the back of the sheet.

Note that in the following description with reference to the drawings, components that are unnecessary for the description are not illustrated, as appropriate, for ease of understanding.

First Exemplary Embodiment

FIG. 1 is an explanatory view of a printer according to a first exemplary embodiment of the invention.

Referring to FIG. 1, a printer U according to the first exemplary embodiment, as the image forming apparatus according to an aspect of the invention, includes an apparatus body U1. The apparatus body U1 has a front surface at which a front covering U2 is disposed. The front covering U2 is supported so as to be openable and closable with a lower end portion thereof as the pivot. The front covering U2 is an example of an opening-closing member for medium replenishing, the opening-closing member being opened and closed when a medium is replenished. The front covering U2 is supported so as to be movable between an open position indicated by the solid line in FIG. 1 and a close position indicated by the broken line in FIG. 1. The open position enables insertion of a sheet, which is an example of the medium. The apparatus body U1 has an upper surface at which a discharge tray TRh, which is an example of a sheet discharge part, is disposed.

Referring to FIG. 1, a control board SC on which various control circuits, a storage medium, and the like, are disposed is disposed at a lower part of the printer U. The control board SC includes, for example, a controller C that performs various types of control of the printer U, an image processing unit GS that is controlled by the controller C in terms of operation thereof, a writing drive circuit DL, which is an example of a drive circuit of a latent image forming device, and a power supply circuit E, which is an example of a power supply device. The power supply circuit E applies a voltage to, for example, charging rollers CRy to CRk, which are an example of a charging member, developing rollers G1*y* to G1*k*, which are an example of a developing member, and first transfer rollers T1*y* to T1*k*, which are an example of a transfer unit.

The image processing unit GS converts print information that has been input into, for example, a personal computer PC into image information for latent images formation. The image information includes information for images of four colors Y, M, C, and K, which are a yellow image, a magenta image, a cyan image, and a black image. The image processing unit GS outputs the image information to the writing drive circuit DL at a preset timing. The personal computer PC is an example of an image information transmitting device electrically connected to the apparatus body U1.

When a document image is a single-color image, that is, monochromatic, only the image information for black is input into the writing drive circuit DL.

The writing drive circuit DL includes a drive circuit (not shown) for each of the colors of Y, M, C, and K. The writing drive circuit DL outputs a signal corresponding to the input image information at a preset timing to LED heads LHy, LHm, LHc, and LHk, which are an example of the latent image forming devices disposed for the colors corresponding thereto.

Referring to FIG. 1, image forming devices UY, UM, UC, and UK are disposed above the control board SC. The image forming devices UY, UM, UC, and UK are an example of a visible-image forming device that forms a toner image. The toner image is an example of a visible image of yellow, magenta, cyan, or black. Referring to FIG. 1, the image forming device UK for black, that is, the color K includes a photoreceptor Pk, which is an example of a rotary image carrier. The charging roller CRk, the LED head LHk, a developing device Gk, a photoreceptor cleaner CLk, and the like, are disposed around the photoreceptor Pk. The charging roller CRk is an example of a charging unit that charges a surface of the photoreceptor Pk. The LED head LHk is an example of the latent image forming device that forms an electrostatic latent image on the surface of the photoreceptor Pk. The developing device Gk develops the electrostatic latent image on the surface of the photoreceptor Pk into a visible image. The photoreceptor cleaner CLk is an example of an image carrier cleaning device that removes a residual developer remaining on the surface of the photoreceptor Pk.

Each of the image forming devices UY, UM, and UC for the other colors has the same configuration as the image forming device UK for black.

Surfaces of the photoreceptors Py, Pm, Pc, and Pk are uniformly charged by the charging rollers CRy, CRm, CRc, and CRk, respectively, in charging regions Q1*y*, Q1*m*, Q1*c*, and Q1*k* corresponding thereto. The charging regions Q1*y*, Q1*m*, Q1*c*, and Q1*k* face the charging rollers CRy, CRm, CRc, and CRk, respectively. After the charging, a latent image is written on each of the photoreceptors Py, Pm, Pc, and Pk by the LED heads LHy, LHm, LHc, and LHk corresponding thereto at respective latent image forming regions Q2*y*, Q2*m*, Q2*c*, and Q2*k*. Each written latent image is developed into a toner image in a developing region Q3*y*, Q3*m*, Q3*c*, or Q3*k* corresponding thereto. The developing regions Q3*y*, Q3*m*, Q3*c*, and Q3*k* face the developing devices Gy, Gm, Gc, and Gk, respectively. The developed toner images are transported to first transfer regions Q4*y*, Q4*m*, Q4*c*, and Q4*k* corresponding thereto, the first transfer regions Q4*y*, Q4*m*, Q4*c*, and Q4*k* being in contact with an intermediate transfer belt B, which is an example of an intermediate transfer body. A first transfer voltage having a polarity opposite to a charge polarity of the toners is applied by the power supply circuit E, which is controlled by the controller C, to the first transfer rollers T1*y*, T1*m*, T1*c*, and T1*k* at a preset timing in the first transfer regions Q4*y*, Q4*m*, Q4*c*, and Q4*k* corresponding thereto. The first transfer rollers T1*y*, Tim, T1*c*, and T1*k* are an example of a first transfer device disposed on a back surface side of the intermediate transfer belt B.

The toner images on the photoreceptors Py to Pk are subjected to a first transfer so as to be transferred by the first transfer rollers T1*y*, T1*m*, T1*c*, and T1*k* corresponding thereto onto the intermediate transfer belt B.

After the first transfer, residues such as a transfer residual toner and a discharge product and an adhering substance on the surface of the photoreceptors Py, Pm, Pc, and Pk are cleaned by photoreceptor cleaners CLy, CLm, CLc, and CLk corresponding thereto. The cleaned surfaces of the photoreceptors Py, Pm, Pc, and Pk are recharged by the charging rollers CRy, CRm, CRc, and CRk corresponding thereto.

The charging rollers CRy, CRm, CRc, and CRk are in contact with charging cleaners CCy, CCm, CCc, and CCk, respectively. The charging cleaners CCy, CCm, CCc, and CCk are an example of a cleaning member for the charging member. The charging cleaners CCy to CCk remove the residues and the like that are not removed by the cleaners CLy to CLk and adhere to the charging rollers CRy to CRk.

Referring to FIG. 1, a belt module BM, which is an example of an intermediate transfer unit, is disposed above the photoreceptors Py to Pk. The belt module BM includes the intermediate transfer belt B, which is an example of the intermediate transfer body and an example of a transfer body. The intermediate transfer belt B is rotatably supported by an intermediate transfer supporting system. The intermediate transfer supporting system includes a belt driving roller Rd, which is an example of a driving member; a backup roller T2*a*, which is an example of a driven member and an example of a second transfer opposing member; and the first transfer rollers T1*y*, T1*m*, T1*c*, and T1*k* disposed so as to face the photoreceptors Py, Pm, Pc, and Pk, respectively.

A belt cleaner CLb, which is an example of a cleaning device for the intermediate transfer body, is disposed on the front side of the intermediate transfer belt B. The belt cleaner CLb includes a cleaning container CLb1, a cleaning blade CLb2, a film CLb3, and a residue transport member CLb4. The cleaning container CLb1 extends in the up-down direction. The cleaning blade CLb2 is an example of a cleaning member that is supported by the cleaning container CLb1 and comes in contact with the intermediate transfer belt B to clean the intermediate transfer belt B by removing residues remaining on the surface of the intermediate transfer belt B. The film CLb3 is an example of a leakage preventing member that prevents or reduces scattering and leakage of the residues removed by the cleaning blade CLb2. The residue transport member CLb4 is disposed at a lower end portion of the cleaning container CLb1. The residue transport member CLb4 discharges the removed residues and transports the residues to a collection container (not shown). The cleaning container CLb1 according to the first exemplary embodiment is disposed such that a lower end thereof in the up-down direction is at a position of the lower end of each of the image forming devices UY to UK, that is, a position of the lower end of each of the developing devices Gy to Gk.

A second transfer roller T2*b*, which is an example of a second transfer member, is disposed so as to face the surface of the intermediate transfer belt B in contact with the backup roller T2*a*. The backup roller T2*a* and the second transfer roller T2*b* constitute a second transfer device T2 according to the first exemplary embodiment. A region where the second transfer roller T2*b* and the intermediate transfer belt B face each other forms a second transfer region Q5.

Single-color or multiple-color toner images sequentially transferred, in the first transfer regions Q4*y*, Q4*m*, Q4*c*, and Q4*k*, by the first transfer rollers T1*y*, T1*m*, T1*c*, and T1*k* corresponding thereto onto the intermediate transfer belt B so as to overlap each other are transported to the second transfer region Q5.

Components such as the first transfer rollers T1*y* to T1*k*, the intermediate transfer belt B, and the second transfer device T2 constitute a transfer device T1+T2+B according to the first exemplary embodiment.

A manual feeding tray TR1, which is an example of a medium stacking part, is disposed below the control board SC. The manual feeding tray TR1 includes a bottom wall TR1*a*, which is an example of a lower wall; a rear end wall TR1*b* extending upward from a rear end of the bottom wall TR1*a*; and an upper wall TR1*c* disposed above the bottom wall TR1*a* so as to be opposite thereto. A replenishing port TR1*d* for replenishing a recording sheet S is disposed at a front end portion of the manual feeding tray TR1. A front end portion of the upper wall TR1*c* inclines further upward toward the outside of the replenishing port TR1*d*, in other words, the front side thereof. Thus, the replenishing port TR1*d* is formed in such a manner that a distance between the upper wall TR1*c* and the bottom wall TR1*a* increases toward the front side, which increasingly widens the replenishing port TR1*d* toward the front side.

An elevating-lowering plate PL1 is disposed on the bottom wall TR1*a*. The elevating-lowering plate PL1 is an example of a medium stacking part that is supported so as to be rotatable around a pivot PL1*a* and on which the recording sheet S, which is an example of a medium, is stacked, the medium stacking part elevating and lowering the recording sheet S. An elevating-lowering spring PL2 is disposed at a rear end portion of the elevating-lowering plate PL1. The elevating-lowering spring PL2 is an example of an urging member that upwardly urges the rear end portion of the elevating-lowering plate PL1. When image forming is not being performed, the elevating-lowering plate PL1 moves to a lowered position at which the elevating-lowering plate PL1 is maintained parallel to the bottom wall TR1*a* by pressing-down members PL3 that are disposed at left and right end portions of the elevating-lowering plate PL1. Each pressing-down member PL3 has an eccentric cam shape. During image forming, the pressing-down members PL3 rotate to enable the elevating-lowering plate PL1 to move between the lowered position and an elevated position, which is illustrated in FIG. 1, where the elevating-lowering plate PL1 is elevated by the elevating-lowering spring PL2.

Thus, when the front covering U2 is opened, the replenishing port TR1*d* is opened to the outside, which enables multiple recording sheets S to be housed by being inserted to come into contact with the rear end wall TR1*b* and stacked on the elevating-lowering plate PL1 that is at the lowered position.

A sheet feeding roller Rp, which is an example of a sending member, is disposed on the rear side of the upper wall TR1*c*. The sheet feeding roller Rp is disposed at a position at which the recording sheet S at the upper most surface of the stacked multiple recording sheets S is pressed against the sheet feeding roller Rp by a spring force of the elevating-lowering spring PL2 in a state in which the elevating-lowering plate PL1 is at the elevated position. A retard pad Rpd, which is an example of a handling member, is disposed at an upper end of the rear end wall TR1*b*. A first sheet feeding path SH6, which is an example of a first transport path, is disposed on the right side of the manual feeding tray TR1. The first sheet feeding path SH6 extends in the up-down direction.

The recording sheets S stacked on the manual feeding tray TR1 are sent by the sheet feeding roller Rp and handled to be separated from each other one by one in an area in which the retard pad Rpd and the sheet feeding roller Rp are in contact with each other. Each of the separated recording sheets S is transported to a manual feeding path SH0. The recording sheet S in the manual feeding path SH0 enters the first sheet feeding path SH6. Registration rollers Rr are disposed at an upper end of the first sheet feeding path SH6. The registration rollers Rr are an example of a transport member and an example of a member that controls timing of sheet feeding. The registration rollers Rr send the recording sheet S into a medium-transport path SH, toward the second transfer region Q5, at a timing when the toner images on the intermediate transfer belt B reach the second transfer region Q5.

After the toner images are transferred onto the intermediate transfer belt B in the second transfer region Q5, the belt cleaner CLb cleans the intermediate transfer belt B by removing residues such as a transfer residual toner and a discharge product remaining on the surface of the intermediate transfer belt B.

The recording sheet S on which the toner images are transferred is transported to a fixing region Q6 of a fixing device F. The fixing device F includes a heating roller Fh, which is an example of a heat-fixing member, and a pressure roller Fp, which is an example of a pressure-fixing member. The fixing region Q6 is a region in which the heating roller Fh and the pressure roller Fp are in contact with each other with a preset pressure. The unfixed toner images on a surface of the recording sheet S are fixed due to heat and pressure when passing the fixing region Q6.

The recording sheet S to which the images are fixed is discharged from discharge rollers Rh onto the discharge tray TRh. The discharge rollers Rh are an example of a medium-discharge member.

A supplemental connection path SH1 for reversing is disposed on the right side of the discharge rollers Rh. The supplemental connection path SH1, which is an example of a transport path, branches from the medium-transport path SH and extends toward the right side. A gate GT1, which is an example of a switching member, is disposed at a branch portion between the supplemental connection path SH1 and the medium-transport path SH. The gate GT1 according to the first exemplary embodiment is formed of an elastically deformable material. The gate GT1 is disposed so as to be capable of transporting the recording sheet S to the discharge rollers Rh by being pushed and elastically deformed by the recording sheet S when the recording sheet S transported along the medium-transport path SH passes the gate GT1, and so as to be capable of guiding the recording sheet S discharged from the discharge rollers Rh to the supplemental connection path SH1 by being elastically restored after passing of the recording sheet S.

The printer U according to the first exemplary embodiment includes a reversing unit U5 supported at a rear surface of the apparatus body U1. A reversing path SH2, which is an example of a second transport path, is disposed inside the reversing unit U5. An upstream end of the reversing path SH2 is connected to a right end of the supplemental connection path SH1 of the apparatus body U1. A downstream end of the reversing path SH2 joins the first sheet feeding path SH6 of the apparatus body U1 on the upstream side of the registration rollers Rr.

In double-sided printing, when a recording sheet S with an image recorded on a first surface thereof is transported along the medium-transport path SH, and a rear end in the transport direction of the recording sheet S passes the gate GT1, the discharge rollers Rh rotate in reverse to send the recording sheet S to the supplemental connection path SH1 and the reversing path SH2. The recording sheet S with the front and back thereof reversed is then re-sent to the registration rollers Rr by being transported by transporting rollers Ra, which are an example of a transport member disposed on the reversing path SH2.

The printer U according to the first exemplary embodiment includes a sheet feeding module U6 disposed below the apparatus body U1. A sheet feeding tray TR2 is disposed inside the sheet feeding module U6. A second sheet feeding path SH7, which is an example of a transport path, is disposed at a rear portion of the sheet feeding module U6. The second sheet feeding path SH7 extends in the up-down direction. An upper end of the second sheet feeding path SH7 is connected to a lower end of the first sheet feeding path SH6.

The sheet feeding tray TR2 according to the first exemplary embodiment is different from the manual feeding tray TR1 in that the sheet feeding tray TR2 is longer in the front-rear direction than the manual feeding tray TR1, and is the same as the manual feeding tray TR1 in terms of other features. Thus, for example, a sheet feeding roller Rp' and an elevating-lowering plate PL1' are disposed inside the sheet feeding module U6 similarly to in the manual feeding tray TR1. Therefore, the recording sheet S fed by the sheet feeding roller Rp' is transported to the first sheet feeding path SH6. The second sheet feeding path SH7 is formed so as to enable passage of a recording sheet S from below when another sheet feeding module U6 is added below the sheet feeding module U6.

Description of Charging Device

Figure 2:
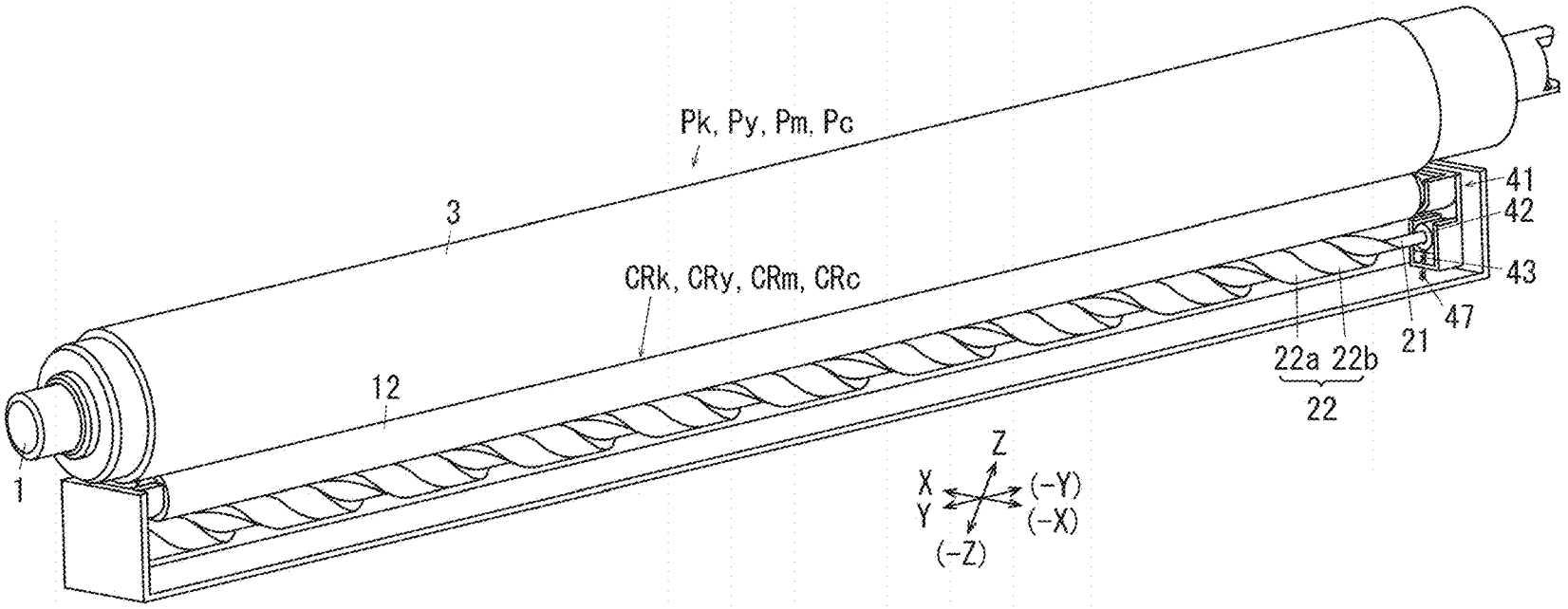
FIG. 2 is a perspective view of a charging device and an image carrier according to the first exemplary embodiment.

FIG. 2 is a perspective view of a charging device and an image carrier according to the first exemplary embodiment.

Figure 3A:
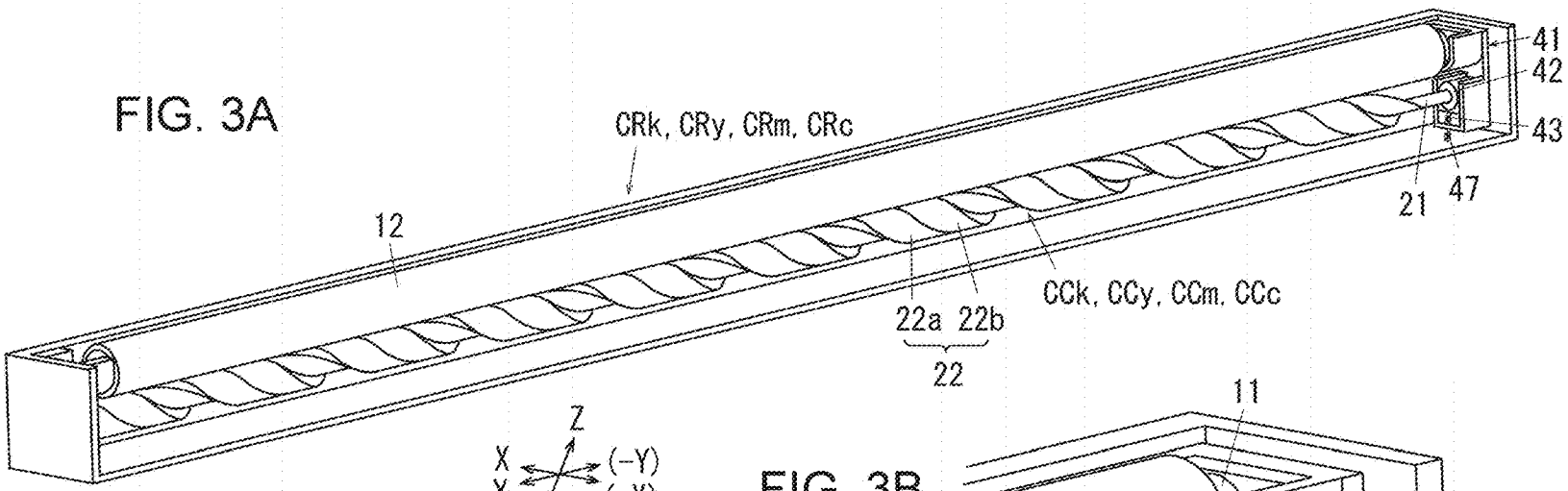
FIG. 3A is a perspective explanatory view of the charging device according to the first exemplary embodiment.
Figure 3B:
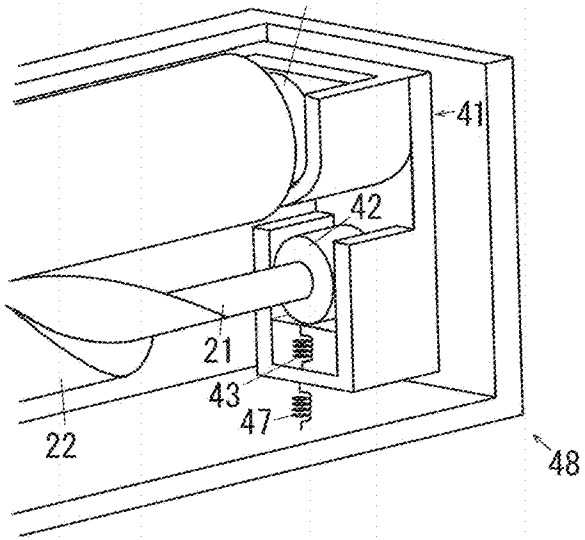
FIG. 3B is an enlarged explanatory view of a portion of the charging device according to the first exemplary embodiment.

FIG. 3A is a perspective explanatory view of the charging device according to the first exemplary embodiment. FIG. 3B is an enlarged explanatory view of a portion of the charging device according to the first exemplary embodiment.

Figure 4:
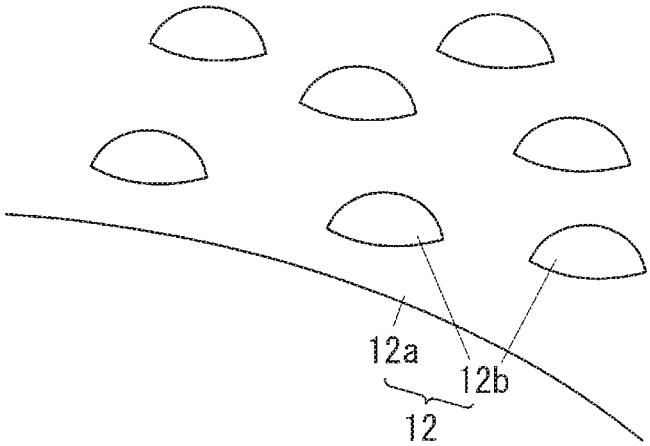
FIG. 4 is an enlarged explanatory view of a surface portion of a charging member according to the first exemplary embodiment.

FIG. 4 is an enlarged explanatory view of a surface portion of a charging member according to the first exemplary embodiment.

The photoreceptors Py to Pk for the colors Y, M, C, and K have the same configuration, and the charging devices for the colors Y, M, C, and K have the same configuration; thus, only the photoreceptor and the charging device for the color K will be described below, and the description of the photoreceptors and the charging devices for the colors Y, M, and C will be omitted.

Referring to FIGS. 2, 3A, and 3B, the photoreceptor Pk according to the first exemplary embodiment is driven to rotate with a rotating shaft 1 as the center of rotation.

Referring to FIGS. 2 to 4, the charging roller CRk according to the first exemplary embodiment includes a core 11, which is an example of a rotating shaft, and an elastic layer 12, which is an example of a charging part supported on an outer periphery of the core 11. The elastic layer 12 according to the first exemplary embodiment includes a resin material 12*a* in which in addition to conductive particles for resistance control, insulating fillers 12*b* of, for example, silica or nylon particles are dispersed in order to form surface irregularities. The surface of the elastic layer 12 thus has irregularities in which the insulating fillers 12*b* are disposed so as to be spaced apart from each other. Such a configuration is publicly known, and thus, detailed description of the configuration will be omitted. The configuration of the charging roller CRk is not limited to the configuration described as an example. For example, the charging roller CRk may have a configuration in which a rubber layer and a resin layer are stacked on each other. The irregularities may be formed by roughening the surface of the resin layer through a roughening process instead of by dispersing the insulating fillers 12*b*. Compared with a configuration without such irregularities, the configuration in which the irregularities are formed prevents abnormal discharge from easily occurring, and thus has high discharging performance and high charging stability.

The charging cleaner CCk includes a core 21, which is an example of a shaft portion, and a cleaning member body 22 wound, in a helical form, around the outer periphery of the core 21.

The cleaning member body 22 according to the first exemplary embodiment includes a first cleaning body 22*a*, which is an example of a first cleaning part, and a second cleaning body 22*b*, which is an example of a second cleaning part. The first cleaning body 22*a* and the second cleaning body 22*b* are disposed adjacent to each other. Thus, the first cleaning body 22*a* and the second cleaning body 22*b* form a double helix around the core 21.

Both ends of the charging cleaner CCk are rotatably supported on bearings 42. The bearings 42 receive an elastic force that presses the charging roller CRk against the charging cleaner CCk, the elastic force being applied by a spring 43, which is an example of an elastic member. Both ends of the charging roller CRk and the bearings 42 of the charging cleaner CCk are supported by movable bodies 41. The movable bodies 41 receive an elastic force that presses the charging roller CRk against the photoreceptor Pk, the elastic force being applied by a spring 47, which is an example of an elastic member.

The charging roller CRk and the charging cleaner CCk constitute a charging device CR+CC according to the first exemplary embodiment.

Description of Cleaning Member

Figure 5:
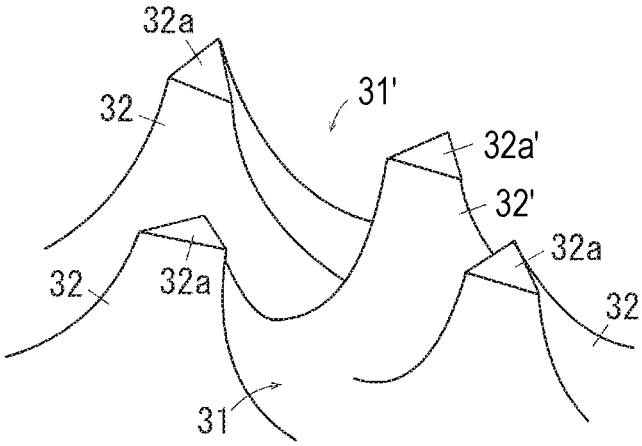
FIG. 5 is an enlarged explanatory view of a surface portion of a cleaning member according to the first exemplary embodiment.

FIG. 5 is an enlarged explanatory view of a surface portion of a cleaning member according to the first exemplary embodiment.

Each of the first and second cleaning bodies 22*a* and 22*b* of the cleaning member body 22 according to the first exemplary embodiment is formed of a sponge or a foam material, which is an example of a porous material. Referring to FIG. 5, the first cleaning body 22*a* according to the first exemplary embodiment has a surface on which multiple first projections 32 formed of a resin are disposed so as to be spaced apart from each other thereby forming spaces 31 in which bubbles are present, and the second cleaning body 22*b* according to the first exemplary embodiment has a surface on which multiple second projections 32' formed of a resin are disposed so as to be spaced apart from each other thereby forming spaces 31' in which bubbles are present. The shape of each top surface 32*a* of most of the first projections 32 and the shape of each top surface 32*a*' of most of the second projections 32' are triangular, as exemplarily illustrated in FIG. 5. However, the shape of the top surfaces 32*a* of some of the first projections 32 and the shape of the top surfaces 32*a*' of some of the second projections 32' are polygonal, for example, substantially rhomboid.

In the first exemplary embodiment, the average of the maximum dimension d of each top surface 32*a* of the first projections 32 of the first cleaning body 22*a* is smaller than the average of the maximum dimension d of each top surface 32*a*' of the second projections 32' of the second cleaning body 22*b*.

Regarding each of the first and second cleaning bodies 22*a* and 22*b*, in general, the larger (larger in terms of expansion ratio and smaller in terms of foam hardness) the diameter of each cell in the porous material, the larger the maximum dimension d. However, the maximum dimension d varies greatly, and thus, the maximum dimension d may be varied by making the cell diameters substantially equal.

In a configuration in which porous materials having different foam hardnesses are employed, if the foam hardness of the second cleaning body 22*b* is reduced (increased in terms of expansion ratio) to increase the maximum dimension d relative to the foam hardness of the first cleaning body 22*a* having the small maximum dimension d according to the first exemplary embodiment, the density of nodes (projections) of the second cleaning body 22*b* becomes smaller than that of the first cleaning body 22*a*, which is not desirable from the viewpoint of cleaning performance. Thus, in the first exemplary embodiment, the maximum dimension d is varied after making the density of nodes (projections) of the first cleaning body 22*a* and the density of nodes (projections) of the second cleaning body 22*b* substantially equal (in other words, substantially equal in terms of foam hardness).

Figure 6:
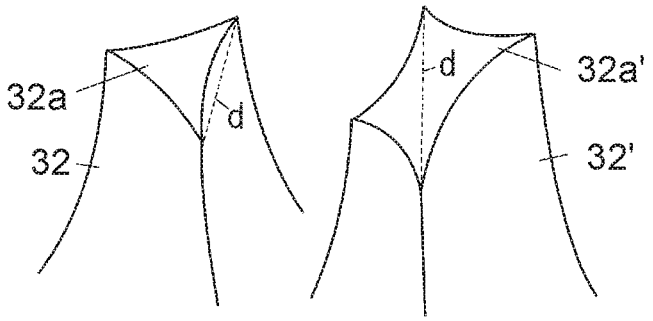
FIG. 6 is an explanatory view illustrating the length of each top surface of the cleaning member according to the first exemplary embodiment.

FIG. 6 is an explanatory view illustrating the length of each top surface of the cleaning member according to the first exemplary embodiment.

Referring to FIG. 6, the average of the maximum dimension d of each of the top surfaces 32*a* and an average of the height 1 of each of the first projections 32 are obtained by imaging the surface of the first cleaning body 22*a*; and the average of the maximum dimension d of each of the top surfaces 32*a*' and an average of the height 1 of each of the second projections 32' are obtained by imaging the surface of the second cleaning body 22*b*. A scanning electron microscope (SEM), which is an example of an electron microscope, is used for the imaging. As illustrated in FIG. 6, in the images of the surface of the first cleaning body 22*a*, the maximum length d of each of the top surfaces 32*a* of 20 pieces of the first projections 32 and the height 1 of each of the 20 pieces of the first projections 32 are measured to derive an average of the maximum lengths d and an average of the heights 1; and in the images of the surface of the second cleaning body 22*b*, the maximum length d of each of the top surfaces 32*a*' of 20 pieces of the second projections 32' and the height 1 of each of the 20 pieces of the second projections 32' are measured to derive an average of the maximum lengths d and an average of the lengths 1.

In the following description, the average of the maximum dimensions d of the top surfaces 32*a* of the first projections 32 of the first cleaning body 22*a* is denoted by da; the average of the heights 1 of the first projections 32 is denoted by la; the average of the maximum dimensions d of the top surfaces 32*a*' of the second projections 32' of the second cleaning body 22*b* is denoted by db; and the average of the heights 1 of the second projections 32' is denoted by lb.

Figure 7:
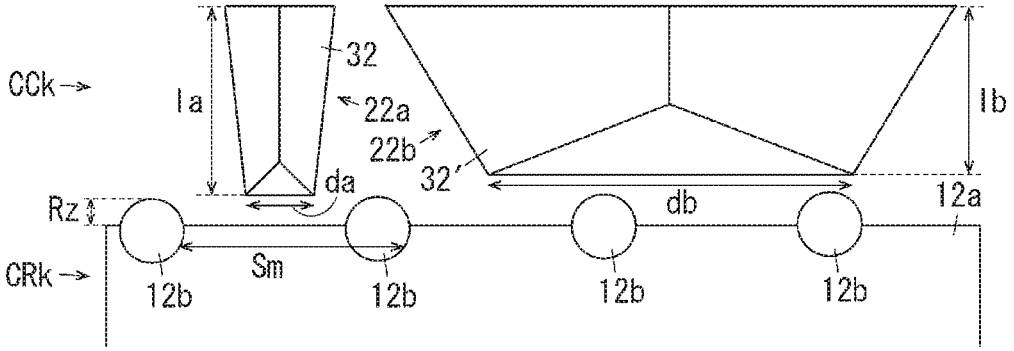
FIG. 7 is an explanatory view illustrating the length of each portion of the charging member according to the first exemplary embodiment and the length of each portion of the cleaning member according to the first exemplary embodiment.

FIG. 7 is an explanatory view illustrating the length of each portion of the charging member according to the first exemplary embodiment and the length of each portion of the cleaning member according to the first exemplary embodiment.

Referring to FIG. 7, an average of distances between projecting portions (insulating fillers 12*b*) adjacent on the roughness curve of the surface of the charging roller CRk is denoted by Sm in the first exemplary embodiment. A maximum height roughness is denoted by Rz. In the first exemplary embodiment, each of the first projections 32 has a shape in which Sm>da and Rz<la are satisfied in the first cleaning body 22*a*. Sm and Rz may be calculated by using, for example, a surface-roughness measuring instrument Surfcom 590A (manufactured by Tokyo Seimitsu Co., Ltd.) in accordance with JIS 94 standard.

In particular, as described above, da<db is satisfied in the first exemplary embodiment. In the second projections 32' of the second cleaning body 22*b*, the average db of the maximum dimensions d of the top surfaces 32*a*' is larger than the average Sm of the distance between the insulating fillers 12*b*. Thus, Sm<db is satisfied. The average lb of the heights 1 of the second projections 32' of the second cleaning body 22*b* is set so as to satisfy Rz<lb.

Effects in First Exemplary Embodiment

In the printer U according to the first exemplary embodiment, having the aforementioned configuration, the first projections 32 each have a size that enables the first projections 32 to reach a bottom (outer surface of the resin material 12*a*) of recessed portions of the surface of the charging roller CRk. Specifically, Sm>da and Rz<la are satisfied.

If Sm>da or Rz>la, the first projections 32 are not capable of reaching the bottom of the recessed portions of the charging roller CRk, which causes stains of, for example, an external additive and paper powder to accumulate on the bottom of the recessed portions over time. Such a circumstance causes defective charging and causes the stains to be transferred from the charging roller CRk onto the photoreceptor Pk, leading to deterioration in image quality.

In contrast, in the first exemplary embodiment, the first projections 32, which reach the bottom of the recessed portions of the surface of the charging roller CRk, clean the bottom of the recessed portions. Thus, stain accumulation is avoided, and deterioration in the image quality due to defective charging and the like is suppressed.

If a surface of the charging roller CRk has irregularities, projecting portions (insulating fillers 12*b*) are easily subjected to a pressure when the charging roller CRk comes into contact with the photoreceptor Pk. Thus, if the projecting portions have an external additive adhering thereto, the external additive firmly sticks to the surfaces of the projecting portions easily, compared with the bottom of the recessed portions. Such a stain firmly sticking to the projecting portions (insulating fillers 12*b*) may not be completely removed by only the thin first projections 32, which reach the bottom of the recessed portions of the first cleaning body 22*a*.

In contrast, in the first exemplary embodiment, the second cleaning body 22*b* in which da<db is satisfied is disposed in addition to the first cleaning body 22*a*. The second projections 32' are thicker than the first projections 32. Therefore, the second projections 32' are high in terms of scraping performance and cleaning performance compared with the first projections 32, which increases the possibility of removing the stains firmly sticking to the projecting portions. In the first exemplary embodiment including the two types of the cleaning bodies 22*a* and 22*b*, it is possible to clean both the recessed portions and the projecting portions of the charging roller CRk.

In particular, Sm<db is satisfied in the first exemplary embodiment. Thus, the second cleaning body 22*b* certainly comes into contact with the projecting portions and cleans the projecting portions.

In the first exemplary embodiment, the first and second cleaning bodies 22*a* and 22*b* are disposed so as to be in a double-helical shape. With the rotation of the charging cleaner CCk, the two cleaning bodies alternately come into contact with each portion of the surface of the charging roller CRk. Thus, a state in which the surface of the charging roller CRk is cleaned only by one of the first and second cleaning bodies 22*a* and 22*b* is avoided. Therefore, it is possible to eliminate or reduce the probability that a part of the recessed portions or the bottom is uncleaned.

EXPERIMENTAL EXAMPLES

Next, experiments to confirm an effect of the exemplary embodiments of the invention are performed.

The experiments are performed by using a modified DocuCentre-V C7775, manufactured by Fuji Xerox Co., Ltd. The experiments are performed for a configuration including only the first cleaning body 22*a* by varying da, la, and the irregularities of the charging roller CRk (Experimental examples 1 and 2 and Comparative examples 1 and 2) and for a configuration including the first cleaning body 22*a* and the second cleaning body 22*b* by varying da, db, and the irregularities of the charging roller CRk (Experimental examples 3 and 4). In each experiment, 200,000 sheets of print samples are printed and the occurrence of a line on each print sample is visually checked. The surface of the charging roller CRk in each experiment is observed by using an SEM.

Experimental results are described below.

FIG. 8 is a table of the experimental results of Experimental examples 1 to 4 and Comparative examples 1 and 2.

Figure 9:
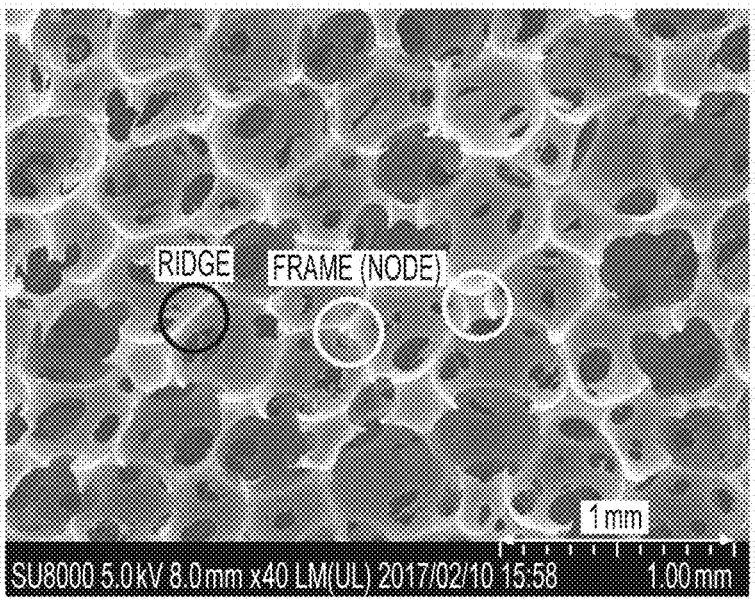
FIG. 9 is an SEM image of the cleaning member in the experimental examples.

FIG. 9 is an SEM image of the cleaning member in Experimental examples 1 to 4.

Referring to FIG. 8, in Experimental examples 1 and 2, Sm>da and Rz<la are satisfied, and the cleaning status of the recessed portions is good. In Experimental example 2, in which da is larger, the projecting portions have less stains.

In Comparative examples 1 and 2, in which Sm<da, the first projections 32 do not reach the bottom of the recessed portions. As a result, stains are accumulated on the recessed portions.

In Experimental examples 3 and 4, in which da<Sm<db is satisfied, both the cleaning status of the recessed portions and the cleaning status of the projecting portions are good.

Second Exemplary Embodiment

Figure 10:
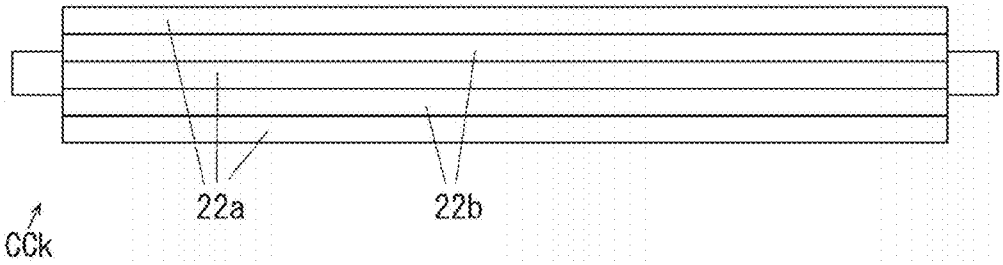
FIG. 10 is an explanatory view of a cleaning member according to a second exemplary embodiment.

FIG. 10 is an explanatory view of a cleaning member according to a second exemplary embodiment.

In the description of the second exemplary embodiment, a component that corresponds to a component in the first exemplary embodiment is given the same reference symbol, and detailed description of the component will be omitted.

The second exemplary embodiment is different from the first exemplary embodiment in terms of the following points and is similar to the first exemplary embodiment in terms of other points.

Referring to FIG. 10, in the charging cleaner CCk according to the second exemplary embodiment, the first cleaning body 22*a* and the second cleaning body 22*b* extend in an axial direction and are alternately disposed in a circumferential direction, instead of being disposed so as to be in the double-helical shape.

Effects of Second Exemplary Embodiment

In the charging device according to the second exemplary embodiment, having the aforementioned configuration, the first cleaning body 22*a* and the second cleaning body 22*b* also alternately come into contact with each portion of the surface of the charging roller CRk. Thus, the projecting portions and the recessed portions of the surface of the charging roller CRk are also properly cleaned.

Modifications

The exemplary embodiments of the invention are described above in detail; however, the invention is not limited to the aforementioned exemplary embodiments and may be variously modified within the scope of the concept of the invention described in the claims. Modifications (H01) to (H08) of the invention are described below as examples.

(H01) In the aforementioned exemplary embodiments, the printer U is presented as an example of an image forming apparatus; however, the image forming apparatus is not limited thereto and may be a facsimile machine, a copier, or a multi-function machine having all functions or having multiple functions. In addition, the image forming apparatus is not limited to a color-image forming apparatus and may be a monochrome-image forming apparatus.

(H02) In the aforementioned exemplary embodiments, a configuration in which the intermediate transfer belt is used as an intermediate transfer body is presented as an example; however, the configuration is a non-limiting example, and a configuration in which an intermediate transfer drum is used may be employed. In addition, a configuration in which the transfer device including the intermediate transfer body is used as a transfer device is presented as an example; however, the configuration is a non limiting example. For example, a configuration in which the intermediate transfer body is omitted and toner images are transferred directly from the photoreceptors Py to Pk onto the recording sheet S, as a transfer body, may be employed.

(H03) In the aforementioned exemplary embodiments, the drum-shaped photoreceptors Py to Pk are presented as an example of the image carrier; however, the image carrier is not limited thereto. For example, a belt-shaped photoreceptor may be used.

(H04) In the aforementioned exemplary embodiments, a configuration that includes the cleaning member body 22 wound around the outer periphery of the shaft so as to be in the helical form is presented as an example of the configuration of each of the charging cleaners CCy to CCk; however, the configuration of each of the charging cleaners is not limited thereto. For example, similarly to the charging rollers CRy to CRk, the charging cleaners CCy to CCk may each have a roll shape. In addition, the configuration of each of the charging cleaners CCy to CCk is not limited to a configuration in which the first cleaning body 22*a* and the second cleaning body 22*b* are disposed in a stripe form as is in the second exemplary embodiment. For example, the configuration may be modified by, for example, disposing the first and second cleaning bodies 22*a* and 22*b* in a zigzag form.

(H05) In the aforementioned exemplary embodiments, a configuration applied to a small image forming apparatus is presented as an example; however, the configuration is applicable also to a medium-sized or large image forming apparatus.

(H06) In the aforementioned exemplary embodiments, a configuration in which the cleaning members are used as the charging cleaners CCy to CCk is presented as an example; however, the configuration is a non-limiting example. For example, the cleaning members are also applicable to a desirable body to be cleaned having surface irregularities, such as a transfer roller.

(H07) In the aforementioned exemplary embodiments, the second cleaning body 22*b* is desirably included, also as indicated by the experimental results; however, a configuration without the second cleaning body 22*b* may be employed. Moreover, a configuration including three or more cleaning parts, for example, a configuration additionally including a third cleaning body may be employed.

(H08) In the aforementioned exemplary embodiments, it is desirable that Sm>da and Rz<la; however, the configuration is not limited thereto. For example, a configuration in which Sm=da or Rz=la or a configuration in which Sm<da or Rz>la may be employed, provided that the first projections 32 are elastically deformable when coming into contact with the surface of the charging roller CRk and capable of reaching the bottom of the recessed portions.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a first cleaning part formed of a porous material, the first cleaning part including first projections each having a size that enables the first projections to pass between projecting portions of an object to be cleaned having surface irregularities and to reach a bottom of recessed portions of the object to be cleaned; and a second cleaning part formed of a porous material, the second cleaning part including second projections larger than the first projections, wherein the cleaning member is configured to clean the object to be cleaned by coming into contact with the object to be cleaned, wherein each of the first projections has a first density, wherein each of the second projections has a second density, and wherein the first density is substantially equal to the second density.

2. The cleaning member according to claim 1, wherein Sm>da, db>da, and Rz<la are satisfied, where Sm denotes an average of distances between the projecting portions adjacent on a roughness curve indicating a sectional shape of a surface of the object to be cleaned, Rz denotes a maximum height roughness, da denotes an average of maximum dimensions of surfaces of the first projections, la denotes an average of heights of the first projections, and db denotes an average of maximum dimensions of surfaces of the second projections.

3. The cleaning member according to claim 1, the cleaning member comprising:

a rotatable shaft portion;

the first cleaning part supported by the shaft portion; and the second cleaning part supported by the shaft portion, wherein the first cleaning part and the second cleaning part are alternately disposed in a circumferential direction of a rotation of the shaft portion.

4. The cleaning member according to claim 2, the cleaning member comprising:

a rotatable shaft portion;

the first cleaning part supported by the shaft portion; and the second cleaning part supported by the shaft portion, wherein the first cleaning part and the second cleaning part are alternately disposed in a circumferential direction of a rotation of the shaft portion.

5. The cleaning member according to claim 3, wherein the first cleaning part and the second cleaning part are supported in a double-helical shape in an axial direction of the shaft portion.

6. The cleaning member according to claim 4, wherein the first cleaning part and the second cleaning part are supported in a double-helical shape in an axial direction of the shaft portion.

7. The cleaning member according to claim 3, wherein the first cleaning part and the second cleaning part are disposed substantially parallel to each other in an axial direction of the shaft portion and adjacently extend in the circumferential direction.

8. The cleaning member according to claim 4, wherein the first cleaning part and the second cleaning part are disposed substantially parallel to each other in an axial direction of the shaft portion and adjacently extend in the circumferential direction.

9. A charging device comprising:

a charging member configured to come into contact with a surface of an image carrier onto which a latent image is formed, wherein the charging member is configured to charge the surface of the image carrier; and the cleaning member according to claim 1, wherein the cleaning member is configured to clean the charging member by coming into contact with the charging member.

10. An image forming apparatus comprising:

an image carrier;

a charging member configured to charge a surface of the image carrier;

the cleaning member according to claim 1, wherein the cleaning member is configured to clean the charging member by coming into contact with the charging member;

a latent image forming device configured to form a latent image on the charged image carrier;

a developing device configured to develop the latent image on the image carrier into a visible image;

a transfer device configured to transfer the visible image on the surface of the image carrier onto a medium; and a fixing device configured to fix the visible image transferred on the medium.

11. The cleaning member according to claim 1, wherein each of the first projections has a first foam hardness, wherein each of the second projections has a second foam hardness, and wherein the first foam hardness is substantially equal to the second foam hardness.

12. The cleaning member according to claim 1, wherein a shape of a top surface of most of the first projections and a shape of a top surface of most of the second projections are triangular, polygonal or substantially rhomboid.

13. The cleaning member according to claim 1, wherein the first projections and the second projections are nodes of the porous material.

* * * * *